US011053611B2

(12) United States Patent
Meinecke

(10) Patent No.: US 11,053,611 B2
(45) Date of Patent: Jul. 6, 2021

(54) OXIDATION FURNACE

(71) Applicant: EISENMANN SE, Böblingen (DE)

(72) Inventor: Lars Meinecke, Reutlingen (DE)

(73) Assignee: EISENMANN SE, Böblingen (DE)

( * ) Notice: Subject to any disclaimer, the term of this patent is extended or adjusted under 35 U.S.C. 154(b) by 0 days.

(21) Appl. No.: 16/327,896

(22) PCT Filed: Aug. 28, 2017

(86) PCT No.: PCT/EP2017/071554
§ 371 (c)(1),
(2) Date: Feb. 25, 2019

(87) PCT Pub. No.: WO2018/041781
PCT Pub. Date: Mar. 8, 2018

(65) Prior Publication Data

US 2019/0194830 A1 Jun. 27, 2019

(30) Foreign Application Priority Data

Aug. 29, 2016 (DE) ..... 10 2016 116 057.1

(51) Int. Cl.
*D01F 9/32* (2006.01)
*F27B 9/28* (2006.01)
(Continued)

(52) U.S. Cl.
CPC ..... *D01F 9/32* (2013.01); *D02J 13/001* (2013.01); *F27B 9/28* (2013.01); *F27B 9/3005* (2013.01); *F27D 17/004* (2013.01)

(58) Field of Classification Search
CPC .... F27B 3/005; F27B 9/12; F27B 9/28; F27B 2009/122; D01F 9/32
See application file for complete search history.

(56) References Cited

U.S. PATENT DOCUMENTS 5,908,290 A * 6/1999 Kawamura ..... D01F 9/32 34/636
6,027,337 A 2/2000 Rogers et al.
(Continued)

FOREIGN PATENT DOCUMENTS

CN 102 782 198 A 11/2012
DE 10 2014 009 243 11/2015
(Continued)

*Primary Examiner* — Gregory A Wilson
(74) *Attorney, Agent, or Firm* — Schroeder Intellectual Property Law Group, LLC

(57) ABSTRACT

An oxidation furnace for the oxidative treatment of fibers, in particular for producing carbon fibers, the furnace having a housing with an inner space which is gas-tight apart from areas for the passage of the fibers. A process chamber is located in the inner space of the housing. Guide rollers guide the fibers arranged adjacently as a fiber carpet in a serpentine manner through the process chamber, the fiber carpet spanning respective planes between opposite guide rollers, a partial area of the inner space being defined both above and below said planes. The process chamber extends between a primary blowing device arranged on a blowing end of the housing and a primary suction device, where a primary gas is blown into a partial area by the primary blowing device in such a way that the process gas flows through the process area in a process flow direction. A secondary gas can be blown into the partial area by a secondary blowing device, on the side of the primary blowing device located at a distance from the process chamber, using a flow sealing device.

34 Claims, 4 Drawing Sheets

(51) Int. Cl.

| | |
|---|---|
| ***D02J 13/00*** | (2006.01) |
| ***F27B 9/30*** | (2006.01) |
| ***F27D 17/00*** | (2006.01) |

(56) References Cited

U.S. PATENT DOCUMENTS

| | | | | |
|---|---|---|---|---|
| 7,004,753 | B2 * | 2/2006 | Stockhausen | D01F 9/32 34/444 |
| 8,955,235 | B2 * | 2/2015 | Berner | D02J 13/001 34/224 |
| 9,139,936 | B2 | 9/2015 | Meinecke et al. | |
| 9,303,921 | B2 | 4/2016 | Berner | |
| 9,441,881 | B2 * | 9/2016 | Berner | F27D 7/00 |
| 10,222,122 | B2 | 3/2019 | Berner et al. | |
| 2012/0304479 | A1 * | 12/2012 | Berner | F27D 7/00 34/203 |
| 2013/0167397 | A1 | 7/2013 | Bagwell et al. | |
| 2013/0171578 | A1 | 7/2013 | Berner | |
| 2014/0026437 | A1 * | 1/2014 | Meinecke | D01F 9/12 34/634 |
| 2016/0209115 | A1 * | 7/2016 | Berner | F27B 9/28 |
| 2017/0122664 | A1 | 5/2017 | Meinecke | |
| 2017/0145598 | A1 * | 5/2017 | Meinecke | D01F 9/32 |
| 2019/0194830 | A1 | 6/2019 | Meinecke | |
| 2020/0181809 | A1 | 6/2020 | Muck et al. | |

FOREIGN PATENT DOCUMENTS

| | | | | |
|---|---|---|---|---|
| EP | 0 848 090 | | 6/1998 | |
| IE | 10 2010 044 296 | B3 | 1/2012 | |
| IE | 10 2011 010 298 | B3 | 6/2012 | |
| JP | 2002-115125 | A † | 4/2002 | |
| JP | 2002115125 | A * | 4/2002 | D02J 13/00 |

* cited by examiner
† cited by third party

OXIDATION FURNACE

RELATED APPLICATIONS

This application is a national phase of International Patent Application No. PCT/EP2017/071554 filed Aug. 28, 2017, which claims priority to German Patent Application No. 10 2016 116 057.1 filed Aug. 29, 2016 the contents of both of which are incorporated herein by reference.

FIELD OF THE INVENTION

The invention relates to an oxidation furnace for the oxidative treatment of fibers, in particular for producing carbon fibers, comprising a) a housing having an interior space which is gastight apart from regions for the passage of the fibers;
b) a process space located in the interior space of the housing;
c) deflection rollers which guide the fibers as fiber carpet next to one another in a serpentine manner through the process space, where the fiber carpet in each case spans a plane between opposite deflection rollers and a subspace of the interior space is in each case defined above and below these planes;
d) a primary blowing-in device arranged at a blowing-in end of the housing and a primary suction device between which the process space extends, where a primary gas can be blown by means of the primary blowing-in device into a subspace in such a way that the process gas flows in a process flow direction through the process space.

BACKGROUND OF THE INVENTION

In such commercially available oxidation furnaces, the blowing-in device comprises, for example, a plurality of blowing-in boxes from which the working atmosphere enters the process space. The process air drawn in by the primary suction device is conveyed by means of a circulation device in a circuit to the primary blowing-in device and in the process subjected to conditioning.

When the primary suction device is arranged at the end of the oxidation furnace opposite to the blowing-in end, this is referred to in the technical field as an oxidation furnace operating according to the "end-to-end" principle. This means that the process air is conveyed through the process space from end to the other end of the oxidation furnace. Such "end-to-end" oxidation furnaces are known, for example, from EP 0 848 090 B1. The advantage of such "end-to-end" oxidation furnaces is that quite homogeneous flow around and onto the fibers can be achieved over the entire process space using only one circulation device; the outlay for construction is comparatively low.

However, in "end-to-end" oxidation furnaces, there are considerable difficulties in preventing both contaminated process air from getting from the outside into the surroundings of the oxidation furnace through the passage regions at the blowing-in end of the housing and also cold air from the surroundings of the oxidation furnace from flowing in an undesirable way into the process space.

During operation, a pressure gradient is established over the height of the oxidation furnace, arising from superimposition of the subatmospheric pressure in the process space by the flowing process air and the thermal pressure gradient due to the ascending of hot process air. Owing to the resulting pressure gradient, harmful air travels outward through the passage regions in the upper part of the oxidation furnace and, secondly, cold air is drawn in from the furnace surroundings through passage regions in the lower part of the oxidation furnace.

SUMMARY OF THE INVENTION

It is an object of the invention to provide an oxidation furnace of the type mentioned at the outset, in which such undesirable flows are reliably prevented.

This object is achieved in an oxidation furnace of the type mentioned at the outset by e) a flow sealing device by means of which a secondary gas can be blown by means of a secondary blowing-in device on the side of the primary blowing-in device opposite the process space into the subspace being provided.

The invention is based on the recognition that a type of counter flow can be built up by means of a secondary gas flow which defines a second blown-in flow in addition to the primary gas flow, by means of which counter flow the abovementioned pressure gradient can be effectively homogenized so that there is no longer a pressure gradient at the blowing-in end and a flow seal has been produced so that harmful air no longer flows in an outward direction and cold air from the furnace surroundings no longer flows into the interior space of the furnace.

This is achieved particularly when the blown-in secondary gas partly flows in the direction toward the process space and partly in the direction away from the process space. It is particularly advantageous for these proportions of the substreams of the secondary gas which flow in the direction toward the process space and in the direction away from the process space to be adjustable. This can be achieved by the pressure drop coefficient of both the flow paths being influenced and the pressure drop in both flow directions being adjustable thereby.

It is particularly advantageous for the pressure drop coefficient of both the flow paths of the secondary gas to be adjustable in each subspace since the flow conditions in the vertically superposed subspaces are different.

Such adjustability of the pressure drop coefficient can advantageously be achieved by the flow sealing device comprising a secondary gas diversion device by means of which the secondary gas stream is diverted in such a way that secondary gas partly flows in the direction toward the process space and partly flows in the direction away from the process space. In this case, the proportions of the substreams in the total volume flow of the secondary gas should, in particular, be adjustable.

It is advantageous for the secondary gas diversion device to comprise a transfer guide device on the secondary blowing-in device and a diversion element, forming a flow channel between the transfer guide device and the diversion element.

It is particularly advantageous for the diversion element to be movable and the flow channel to be able to be altered.

To be able to set the flow conditions over the height of the oxidation furnace, it is advantageous for primary gas to be able to be blown by means of the primary gas blowing-in device into each subspace and secondary gas to be able to be blown by means of the secondary blowing-in device into each subspace.

A secondary gas diversion device is preferably also provided in each subspace.

An advantageous solution for introduction of the primary gas and of the secondary gas is for the primary blowing-in device to comprise one or more primary blowing-in boxes and the secondary blowing-in device to comprise one or more secondary blowing-in boxes.

A primary blowing-in box and a secondary blowing-in box which are arranged directly next to one another in the same subspace and blow primary gas or secondary gas, respectively, in opposite directions are advantageous.

To prevent the part of the secondary gas which flows away from the process space from getting out to the outside, it is advantageous for a secondary suction device by means of which this substream of the secondary gas can be sucked away to be present.

It is also advantageous for a fresh gas feed device by means of which fresh gas can be blown into the interior space to be present at the blowing-in end of the housing, with the fresh gas feed device being arranged, in particular, on the side of the secondary suction device opposite the process space.

BRIEF DESCRIPTION OF THE DRAWINGS

In the following, a working example of the invention will be explained in more detail with the aid of the drawings. The drawings show.

DETAILED DESCRIPTION OF THE INVENTION

Figure 1:
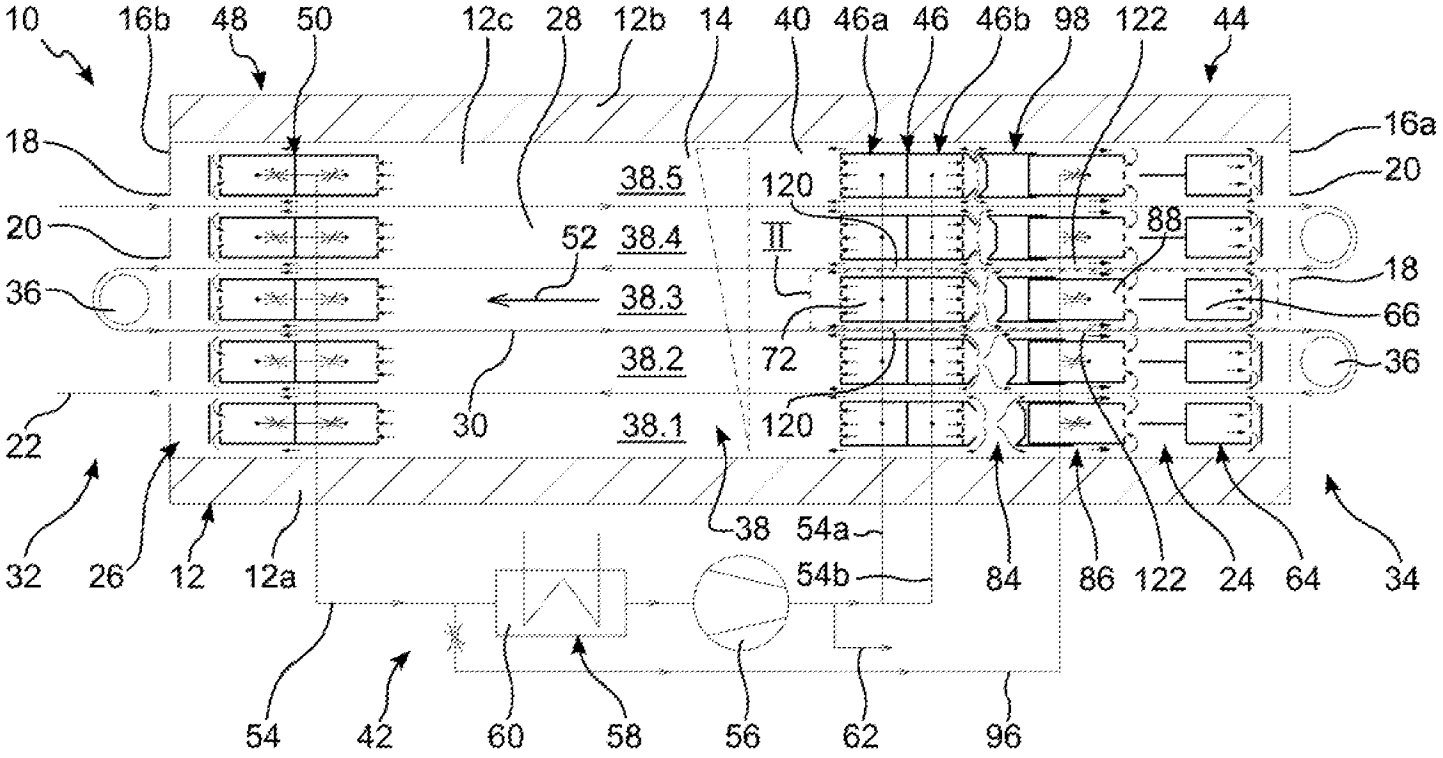
FIG. 1 a vertical section through an oxidation furnace for producing carbon fibers in the longitudinal direction of the furnace, comprising an atmosphere device by means of which a hot working atmosphere can be produced and a primary gas can be blown at a blowing-in end into a process space and further comprising a flow sealing device at the blowing-in end.

FIG. 1 shows a vertical section through an oxidation furnace 10 which is used for producing carbon fibers. The oxidation furnace 10 comprises a housing 12 which bounds the flow-through space forming the interior space 14 of the oxidation furnace 10 by means of a bottom wall 12*a*, an upper wall 12*b* and two vertical longitudinal walls of which only one longitudinal wall 12*c* located behind the plane of the section can be seen in FIG. 1.

At its end faces, the housing 12 has in each case an end wall 16*a*, 16*b*, with the end wall 16*a* having passage openings in the form of horizontal inlet slits 18 and outlet slits 20 which alternate from the bottom upward and the opposite end wall 16*b* having passage openings in the form of horizontal outlet slits 20 and inlet slits 18 which alternate from the bottom upward; in the interest of clarity, these are not all provided with a reference symbol. Through the inlet and outlet slits 18 and 20, respectively, fibers 22 are conveyed into the interior space 14 and out from this again. The inlet and outlet slits 18, 20 generally form passage regions of the housing 12 for the carbon fibers 22. Apart from these passage openings, the housing 12 of the oxidation furnace 10 is gastight.

The interior space 14 is in turn divided into three regions in the longitudinal direction and comprises a first prechamber 24 which is arranged directly next to the end wall 16*a*, a second prechamber 26 which is directly adjacent to the opposite end wall 16*b* and also a process space 28 located between the prechambers 24, 26.

The prechambers 24 and 26 thus effectively form an inlet and outlet lock for the fibers 22 into the interior space 14 or the process space 28.

The fibers 22 to be treated are fed parallel to one another as a type of fiber carpet 30 into the interior space 14 of the oxidation furnace 10. For this purpose, the fibers 22 travel from a first deflection region 32 located next to the end wall 16*b* outside the furnace housing 12 and through the uppermost inlet slit 18 in the end wall 16*b* into the prechamber 26. The fibers 22 are then conveyed through the process space 28 and through the opposite prechamber 24 to a second deflection region 34 located next to the end wall 16*a* outside the furnace housing 12, and back again from there.

Overall, the fibers 22 travel through the process space 28 in a serpentine manner via deflection rollers 36 which are arranged successively from the top downward and of which only two are provided with a reference symbol. Between the deflection rollers 36, the fiber carpet 30 formed by the plurality of fibers 22 running parallel to one another in each case spans a plane, with a subspace 38 of the interior space 14 being in each case defined above and below these planes. In the working example shown in FIG. 1, five such subspaces 38.1, 38.2, 38.3, 38.4, 38.5 are defined from the bottom upward. The fibers 22 can also run from the bottom upward and more or fewer planes than is shown in FIG. 1 can also be spanned and, correspondingly, more or fewer subspaces 38 of the interior space 14 can be defined.

After passing through all of the process space 28, the fibers 22 leave the oxidation furnace 10 through the lowermost outward slit 20 in the end wall 16*b* in the case of the present working example. Before reaching the uppermost inlet slit 18 in the end wall 16*b* and after leaving the oxidation furnace 10 through the lowermost outlet slit 20 in the end wall 16*b*, the fibers 22 are conveyed outside the furnace housing 12 over further guide rollers which are not shown individually.

Under process conditions, a hot working atmosphere 40, which is built up by an atmosphere device 42, flows through the process space 28. Expressed in general terms, a hot working atmosphere 40 can be generated by means of the atmosphere device 42 and blown into the process space 28, and under process conditions flows through the process space 28. In practice, the working atmosphere is air, for which reason the term air will hereinafter also be chosen synonymously for all gases which contribute to the atmosphere management of the oxidation furnace and the terms process air, circulating air, exhaust air, fresh air and the like will be employed; however, other gases can also be conveyed through the process space 28.

In the present working example, the oxidation furnace 10 is configured according to the "end-to-end" principle and defines a blowing-in end 44 having a blowing-in device 46 and a suction end 48 having a primary suction device 50, between which the working atmosphere 40 flows in a main or process flow direction 52 through the process space 28. The blowing-in end 44 is located at the end of the oxidation furnace having the end wall 16*b*, and the suction end 48 is located at the opposite end having the end wall 16*a*. Furthermore, all arrows which can be seen in the figures in each case indicate flows or flow directions.

Between the primary suction device 50 and the blowing-in device 46, the working atmosphere 40 is conveyed through a circulation conduit 54 having a blower 56 and flows through a conditioning device 58 which is shown by way of example as heat exchanger 60 since, in particular, the temperature of the working atmosphere is set by means of the conditioning device 58. Upstream of the conditioning device 58, an exhaust air conduit 62 having a valve which is not shown individually branches off from the circulation conduit 54, so that a proportion of the circulated working atmosphere 40 can be discharged via this exhaust air conduit.

In order to maintain the air management of the oxidation furnace 10, the proportion of the exhaust gas volume which flows out can be compensated for by a fresh air feed device 64 which is provided at the blowing-in end 44 of the oxidation furnace 10 and there in the prechamber 24. The fresh air feed device 64 comprises a plurality of feed channels 66 which are supplied with fresh air and are arranged in the subspaces 38 and of which only one bears a reference symbol. The feed channels 66 extend transversely to the process flow direction 52 and thus transversely to the longitudinal direction of the furnace.

Figure 2:
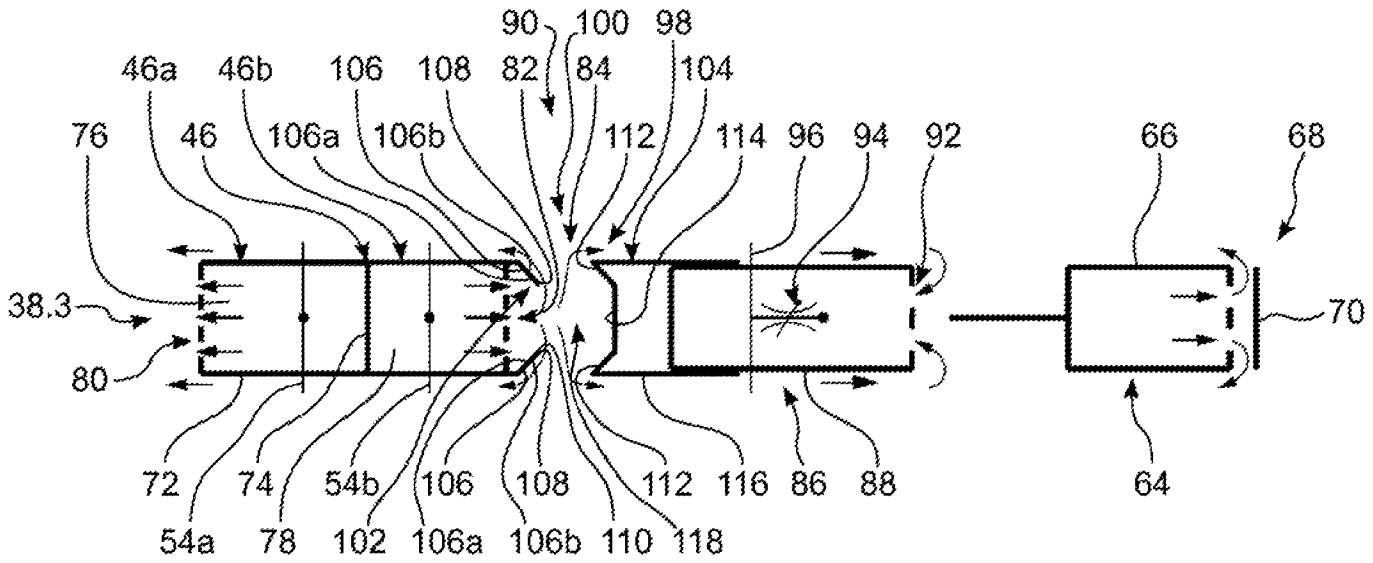
FIG. 2 a detail from the vertical section of FIG. 1 corresponding to the broken line II there.

FIG. 2 shows an enlargement of a section of the subspace 38.3 which is enclosed by a broken line in FIG. 1 and denoted by II. It can readily be seen in FIG. 2 that each feed channel 66 has an outlet side 68 which points in the direction of the end wall 16*a* and through which fresh air is introduced over the width of the oxidation furnace 10 in the direction pointing away from the process space 28. Each feed channel 66 is assigned a guide plate 70 which is arranged in front of the outlet side 68 so that the exiting fresh air flows out in the direction of the fibers 22.

All components referred to here and in the following as plate or the like can be made of metal and thus optionally be a structural plate or else can be made of a nonmetallic material; the term "plate" is intended to define in principle the relatively thin structure of such components.

The gases discharged via the exhaust air conduit 62, which can also contain toxic constituents, are fed to a thermal after-combustion. The possible recovered heat can be used at least for pretreating the fresh air fed to the oxidation furnace 10.

The air goes via the circulation conduit 54 to the blowing-in device 46. This transfers the now circulated and conditioned air as process air into the process space 28. During the serpentine passage of the fibers 22 through the process space 28, hot, oxygen-containing process air flows around the fibers 22 and the latter are oxidized.

The blowing-in device 46 comprises a blowing-in box 72 in each subspace 38; only the blowing-in box 72 in the subspace 38.3 is provided with a reference symbol in FIG. 1 and is shown on a larger scale in FIG. 2. Only in the latter are the components of the blowing-in device 46 described below provided with reference symbols. The moving fiber carpet 30 in each case spans the free spaces between the blowing-in boxes 72 arranged above one another in the vertical direction.

The blowing-in boxes 72 are divided by a dividing wall 74 into a primary blowing-in box 76 and a secondary blowing-in box 78. The circulation conduit 54 branches out into two supply arms 54*a*, 54*b* of which one is connected to the primary box 76 and the other is connected to the secondary box 78 so that the primary box 76 and the secondary box 78 are supplied with circulated air.

The primary boxes 76 each have a hydrodynamically open primary outlet window 80 which extends transverse to the longitudinal direction of the furnace and through which primary gas, i.e. in the present case primary air, flows into the process space 28. These primary outlet windows 80 of the blowing-in device 46 point in the direction of the primary suction device 50 opposite. A primary blowing-in device 46*a* is formed in this way.

Hydrodynamically open means that a gas flow can pass through the windows described here and in the following. For this purpose, the windows can, for example, be formed by a respective wall being omitted. However, if desired, a wall can also be provided with flow passages.

In addition, the secondary boxes 78 of the blowing-in boxes 72 have a hydrodynamically open secondary outlet window 82 which is located on the side opposite the primary outlet window 80 and consequently faces in the direction of the end wall 16*a* and through which secondary gas, i.e. secondary air in the present case, flows into the prechamber 24 of the oxidation furnace 10 in the direction opposite to the process flow direction 52. This forms, expressed in general terms, a secondary blowing-in device 46*b* through which secondary gas can be blown on the side of the primary blowing-in device 46*a* opposite the process space 28 into the subspaces 38.

In a modification which is not shown individually, the primary blowing-in device 46*a* and the secondary blowing-in device 46*b* can each be formed by separate blowing-in boxes having appropriate primary and secondary outlet windows rather than by the primary boxes 76 and the secondary boxes 78 which share the dividing wall 74.

The volume flow ratio between primary air and secondary air is influenced by the position of the respective dividing wall 74 in the blowing-in boxes 72 when these are supplied by the joint blower 56. When the primary boxes 76 and the secondary boxes 78 are each supplied by a dedicated blower, the position of the dividing wall 74 is immaterial. In practice, a ratio of 65%-70% via the primary blowing-in boxes 76 and 35%-30% via the secondary blowing-in boxes 78 has been found to be advantageous.

The secondary blowing-in device 46*b* is part of a flow sealing device 84 by means of which exit of polluted process air from the oxidation furnace 10 is prevented.

This flow sealing device 84 additionally comprises a secondary suction device 86 which in each subspace 38 has a secondary section box 88 which is arranged at a distance from the secondary blowing-in chamber 78 in the respective subspace 38. Of these secondary suction boxes 88, only the suction box 88 in the subspace 38.3 is provided with a reference symbol in FIG. 1, and this suction box is shown on a larger scale in FIG. 2. The moving fiber carpet 30 spans the free spaces between the secondary suction boxes 88 which are arranged above one another in the vertical direction. A flow space 90 of the flow sealing device 84 remains between each secondary blowing-in device 46*b* and each secondary suction box 88 in each subspace 38.

The secondary suction boxes 88 each have a hydrodynamically open suction window 92 on the side opposite the secondary blowing-in device 46*b*, and this window consequently faces in the direction of the end wall 16*a* of the housing 12. Air can be sucked out of the interior space 14 through the secondary suction boxes 88. For this purpose, the secondary suction boxes 88 are connected in each case via a valve 94 to a suction conduit 96 which opens into the circulation conduit 54 upstream of the blower 56 and in the present working example also upstream of the conditioning device 58. The suction volume flow for each suction box 88 can be set via the respective valve 94.

In a modification which is not shown individually, the valves 94 can also be omitted.

The flow sealing device 84 further comprises a flow guide device by means of which the flow ratios in the flow spaces 90 between the secondary blowing-in devices 46*b* and the secondary suction device 86 can be set.

The flow guide device 98 comprises, in each subspace 38, a secondary gas diversion device 100 by means of which the secondary gas stream is diverted in such a way that secondary gas partly flows in the direction toward the process space 28 and partly flows in the direction away from the process space 28. Each secondary gas diversion device 100 in turn comprises a transfer guide device 102 at the secondary outlet window 82 of the secondary blowing-in chamber 78 and a diversion element 104 against which the secondary air from the secondary blowing-in chamber 78 flows.

The diversion element 104 is movable so that the distance between the transfer guide device 102 and the diversion element 104 can be altered and can be set for each subspace 38.

In the working example shown here, the transfer guide device 102 comprises two guide plates 106 which are installed top and bottom on the secondary outlet window 82 and have free outer peripheries 108 which converge in the exit direction of the secondary air and whose surfaces facing one another are characterized as inner surfaces 106*a* and whose surfaces facing away from one another are characterized as outer surface 106*b*. In this way, an outlet gap 110 for the secondary air is formed between the free edges 108 of the guide plates 106. The secondary air exiting from the secondary outlet window 82 is bundled together by the respective inner surfaces 106*a* of the guide plates 106. The two guide plates 106 run, in the present working example, at an angle of 45° to a horizontal plane.

The diversion element 104 defines inclined flow surfaces 112 which are each arranged in the horizontal direction opposite the guide plates 116 and between which an impingement surface 114 runs. In the present working example, the inclined flow surfaces 112 run parallel to the outer surfaces 106*a* of the guide plates 106; the impingement surface 114 runs vertically.

The diversion element 104 is configured as push-on component 116 which has a shape complementary to a secondary suction box 88, so that it can be pushed onto the secondary suction box 88 and moved on this.

This forms, in each subspace 38, an alterable flow channel 118 through which secondary air can flow in the upward direction and downward in the direction of the respective fiber carpets 30 running there, with the flow cross section of this flow channel being able to be adjusted.

The oxidation furnace 10 and its flow sealing device 84 then function as follows:

Primary air is blown in the process flow direction 50 into the process space 28 by means of the primary blowing-in device 46*a* and the primary blowing-in chamber 76 thereof. At the same time, secondary air is blown in the opposite direction into the flow spaces 90 of the flow sealing device 84 by means of the secondary blowing-in device 46*b* and the secondary blowing-in boxes 78 thereof. The transfer volume stream of the primary blowing-in device 46*a* and the transfer volume stream of the secondary blowing-in device 46*b* have a constant ratio in each blowing-in box 72 and can be set structurally via the position of the dividing wall 74 in the blowing-in box 72; in practice, this ratio is from 3:1 to 3:2.

The free spaces below above the blowing-in boxes 72 and the free spaces below and above the diversion elements 104 and the secondary suction boxes 88 form flow passages 120 and 122, respectively; only the two flow passages 120, 122 at the subspace 38.3 are provided with reference symbols in FIG. 1.

The secondary air blown into the flow channels 118 is divided by the secondary gas diversion device 100 and flows, in each subspace 38, upward and downward in the flow channel 118 and then into the flow passages 120 and 122 there.

Part of the secondary air then flows in the flow passages 120 into the process space 22. Another part of the secondary air flows in the flow passages 122 in the opposite direction in the direction of the end wall 16*a* of the housing 12 to the suction windows 92 of the secondary suction boxes 88. These volume streams which flow through the flow passages 122 in the direction of the end wall 16*a* are drawn off by means of the secondary suction device 86 and the secondary suction boxes 88 thereof and recirculated into the circulation conduit 54.

In the lowermost subspace 38.1, the diversion element 104 is, for example, positioned so that there is a large distance to the transfer guide device 102, in which the flow channel 118 has no guiding or diverting effect on the secondary air there. As a result, the secondary air is divided half-and-half in the subspace 38.1 into the substreams through the flow passages 120 and 122, with the pressure drop in both substreams being equal.

In the upward direction, the diversion elements 104 in the individual subspaces 38 are successively positioned ever closer to the respective transfer guide device 102, so that the flow channel 118 resulting in each case in each subspace 38 becomes ever narrower in the upward direction. This can be seen readily in FIG. 1. The respective secondary air stream in the subspaces 38 is diverted ever more strongly by the guide plates 106 of the transfer guide device 102 and the associated inclined flow surfaces 112 of the secondary gas diversion device 100 so that an ever greater proportion of secondary air having a flow direction in the process flow direction 50 is obtained, i.e. an ever greater proportion of the secondary air flows into the flow passage 120 in the direction toward the process space 28 and an ever smaller proportion of the secondary air flows into the flow passage 122 in the direction toward the end wall 16*a* of the housing 12.

As a result of the forced flow directions, the respective dynamic pressure of the secondary air in the subspaces 38 acts against the positive internal pressure of the oxidation furnace 10, with the pressure drop coefficient toward the outside increasing successively from the bottom upward from subspace 38 to subspace 38.

The flow channel 118 can consequently be altered by means of the movable diversion element 104 in such a way that the pressure drop coefficient of both flow paths is influenced and the pressure drop in both flow directions can be set thereby.

In this way, the volume flow division can be controlled and the pressure gradient over the height of the oxidation furnace 10, which results from the superimposition of the subatmospheric pressure in the process space due to the flowing process air and the thermal pressure gradient, can be homogenized. This prevents harmful air getting to the outside through inlet and outlet slits 18, 20 in the upper region of the oxidation furnace 10 and also prevents cold air being sucked in from the furnace surroundings through inlet and outlet slits 18, 20 in the lower region of the oxidation furnace 10.

A flow seal is thus formed.

A corresponding flow sealing device 84 can also be used in an oxidation furnace whose air management is operated according to the "end-to-end center" principle.

In modifications which are not shown individually, secondary air can, for example, also be blown in through separate blowing-in nozzles which are arranged in the subspaces 38 and whose transfer direction, transfer pressure and transfer volume flow can be set appropriately, with, in particular, the transfer pressure and the transfer volume flow being increased from the bottom upward.

Figure 3:
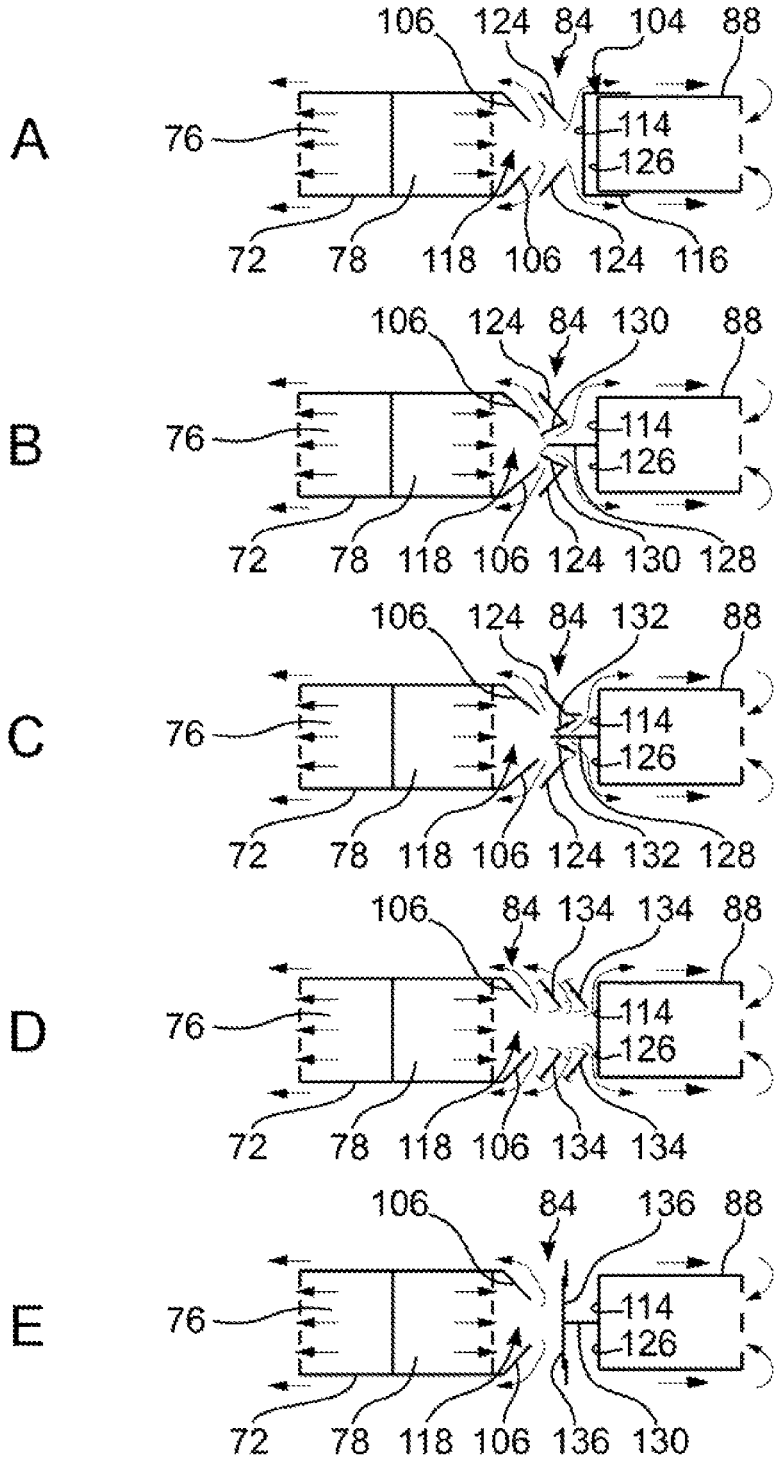
FIGS. 3-A to 3-I various working examples of the flow sealing device with the aid of details similar to FIG. 2.
Figure 3:
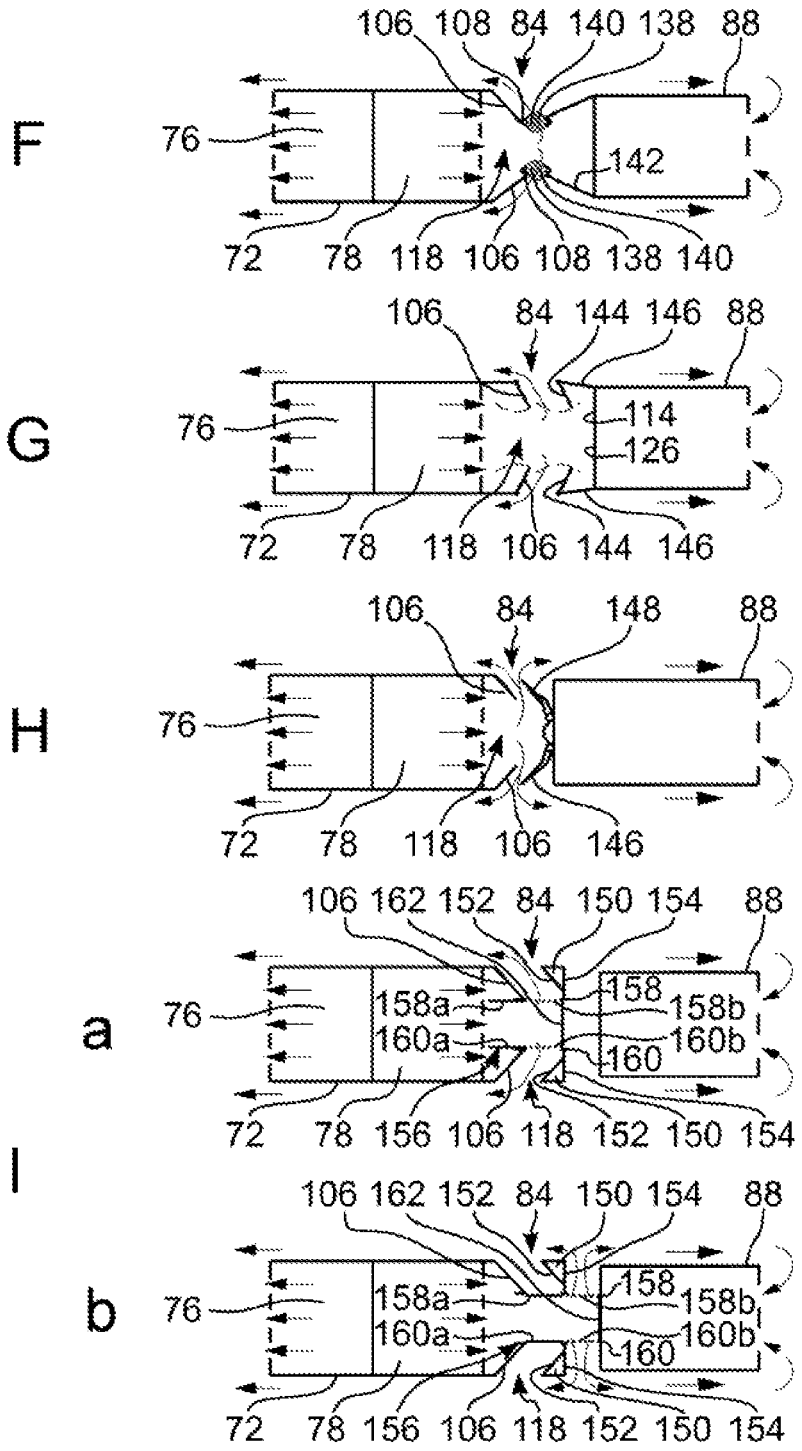

FIGS. 3-A to 3-I show various working examples of the flow sealing device 84, with components which have been described above and correspond functionally or structurally to one another being provided with the same reference symbols as in FIG. 1 or 2 and with only essential components being provided with a reference symbol. The stream of the secondary gas can be divided and diverted partly in the direction toward the process space 28 and partly in the direction away from the process space 28 by means of the flow sealing devices 84 shown there, so that firstly the thermal superatmospheric pressure of the oxidation furnace 10 is compensated for and secondly inflow of cold air from the outside is prevented.

In the working example shown in FIG. 3-A, the diversion element 104 and thus the push-on component 116 has only a flat and vertically oriented impingement surface 114 without inclined flow surfaces 112. Instead, two obliquely positioned flow plates 124 are arranged in the flow channel 118. In the present working example, these flow plates 124 run parallel to the respective horizontally adjacent guide plate 106; other setting angles are, however, possible. The flow proportions of the secondary air can be set as a function of the positioning of the push-on component 116.

In the working example shown in FIG. 3-B, there is no separate diversion element 104 or push-on component 116. Rather, the flat impingement surface 114 is formed by the outer surface 126 of the secondary suction box 88 which faces the flow channel 118. A dividing plate 118 running in a horizontal plane projects from this outer surface 126 into the flow channel 118.

In this working example, too, there are the inclined flow plates 124 which here no longer run parallel to the guide plates 106 but instead run more steeply relatively to a horizontal plane. At the ends which in each case face the dividing plate 128, the flow plates 124 each have a pivotable flow flap 130 which can be adjusted between a first closure position in which the free ends thereof rest against the dividing plate 128 and a second closure position in which the free ends thereof rest against the free ends of the guide plates 106.

In the first closure position, the flow path between the flow plates 124 and the outer surface 126 of the secondary suction box 88 is shut off, while in the second closure position the flow path between the guide plates 106 and the flow plates 124 is shut off. The flow proportions of the secondary air can be set as a function of the setting of the flow flaps 130.

In the working example shown in FIG. 3-C, rotatable throttle flaps 132 by means of which the flow path between the flow plates 124 and the outer surface 126 of the secondary suction box 88 can be alternatively shut off or opened with various flow cross sections are provided instead of the flow flaps 130. The flow path between the guide plates 106 and the flow plates 124 always remains open in this working example.

The working example shown in FIG. 3-D corresponds approximately to the working example of FIG. 3-C, but there is no dividing plate and instead of the fixed flow plates 124 there are in each case two pivotable flow plates 134 upward and downward in the flow direction. Depending on the inclination of these, the flow proportions of the secondary air alter.

In the working example shown in FIG. 3-E, a dividing plate 128 is again present in the flow channel 118 at the suction box 88. The flow path above and below the dividing plate 128 can be opened or shut there with variable cross section by two sliders 136.

In the working example shown in FIG. 3-F, rotatable flow rollers 138 having flow passages 140 are positioned along the free edges 108 of the guide plates 106, from which flow rollers further guide plates 142 extend divergently to the secondary suction box 88. In this way, the flow channel 118 is effectively housed. Depending on the rotary setting of the rotatable flow rollers 138, the flow proportions of the secondary air in the two directions can be set.

The working example shown in FIG. 3-G shows a variant in which the guide plates 106 are pivotably mounted. At a distance from the guide plates 106, further pivotable plates 144 are mounted on largely horizontal walls 146 which in turn are fastened to the secondary suction box 88 and by means of which a spacing of the pivotable plates 144 from the outer surface 126 is ensured. The guide plates 106 and the further pivotable plates 144 can be pivoted so as to be parallel or not parallel to one another; the flow proportions of the secondary air in the two directions alters as a function of the settings of the guide plates 106 or of the further pivotable plates 144.

In the working example shown in FIG. 3-H, the guide plates 106 are again arranged in a fixed manner. Pivotable guide plates 148 are then mounted on the outer surface 126 of the secondary suction box 88, with the ends, attached in an articulated manner, of these pivotable guide plates being in each case arranged close to the middle in the vertical direction of the secondary suction box 88. In the present working example, the pivotable guide plates 148 are curved in the direction into the flow channel 118. The flow proportions of the secondary air in the direction toward the process space 28 and in the direction away from the process space 28 can be set as a function of the setting of the pivotable guide plates 148.

In the working example shown in FIGS. 3-Ia and 3-Ib, flow wedges 150, which each define an inclined guide surface 152 which is parallel relative to the respective horizontally adjacent guide plate 106 and faces in the direction of the guide plates 106, are arranged between the guide plates 106 and the secondary suction box 88. In the direction towards the flat and vertical impingement surface 114 of the secondary suction box 88, the flow wedges 150 each have a likewise vertical guide surface 154. The inner edge, relative to the flow channel 118, of the flow wedges 150 is in each case arranged at the same height as the free edges 108 of the neighboring guide plates 106 in the horizontal direction.

A hollow guide box 156 is movably mounted between the flow wedges 150 and the guide plates 106; this hollow guide box has an upper wall and a lower wall 158 or 160, respectively, which in turn have a closed section 158*a* or 160*a* and a section 158*b* or 160*b* provided with flow passages. The sections 158*b* and 160*b* provided with flow passages have an extension in the horizontal direction which corresponds to the spacing between the flow wedges 150 and the secondary suction box 88. The end face of the guide box 156 in the direction of the blowing-in boxes 72 is open, while the end face of the guide box 156 is closed by an end wall 162 in the direction toward the secondary suction box 88.

At a first maximum setting of the guide box 156, the end wall 162 thereof is flush with the vertical guide surfaces 154 of the flow wedges 150, as a result of which only a flow path for the secondary air through the wall sections 158*b* and 160*b* provided with flow passages and further between the guide plates 106 and the inclined guide surfaces 152 of the flow wedges 150 is possible. Flow of the secondary air past the flow wedges 150 in the direction toward the secondary suction box 88 is prevented by the closed end wall 162 of the guide box 156. This can be seen in FIG. 3-Ia.

At a second maximum setting of the guide box 156, the end wall 162 thereof rests against the outer surface 126 of the secondary suction box 88, so that only a flow path for the secondary air through the wall sections 158*b* and 160*b* provided with flow passages and further between the vertical guide surfaces 154 of the flow wedges 150 and the outer surface 126 of the secondary suction box 88 is possible. Flow of the secondary air between the guide plates 106 and the inclined guide surfaces 152 of the flow wedges 150 is prevented by the closed wall sections 158*a* and 160*a* of the guide box 150. This is shown in FIG. 3-Ib.

What is claimed is:

1. An oxidation furnace for the oxidative treatment of fibers, comprising:

a) a housing having an interior space which is gastight apart from regions for the passage of fibers;

b) a process space located in the interior space of the housing;

c) deflection rollers which guide the fibers as fiber carpet next to one another in a serpentine manner through the process space, where the fiber carpet in each case spans a plane between opposite deflection rollers and a subspace of the interior space is in each case defined above and below these planes;

d) a primary blowing-in device arranged at a blowing-in end of the housing and a primary suction device between which the process space extends, where a primary gas can be blown by means of the primary blowing-in device into a subspace in such a way that the process gas flows in a process flow direction through the process space;

wherein e) a flow sealing device by means of which a secondary gas can be blown by means of a secondary blowing-in device on the side of the primary blowing-in device opposite the process space into the subspace is provided, the flow sealing device comprising a secondary gas diversion device by means of which the secondary gas stream is diverted in such a way that secondary gas partly flows in the direction toward the process space and partly flows in the direction away from the process space.

2. The oxidation furnace as claimed in claim 1, wherein a pressure drop coefficient of the flow path of the secondary gas in the subspace can be set.

3. The oxidation furnace as claimed in claim 1, wherein the secondary gas diversion device comprises a transfer guide device on the secondary blowing-in device and a diversion element, with a flow channel being formed between the transfer guide device and the diversion element.

4. The oxidation furnace as claimed in claim 3, wherein the diversion element is movable and the flow channel can be altered.

5. The oxidation furnace as claimed in claim 1, wherein the primary gas can be blown into each subspace by means of the primary gas blowing-in device and the secondary gas can be blown into each subspace by means of the secondary blowing-in device.

6. The oxidation furnace as claimed in claim 5, wherein each subspace includes a secondary gas diversion device by means of which the secondary gas stream in the respective subspace is diverted in such a way that secondary gas partly flows in the direction toward the process space and partly flows in the direction away from the process space.

7. The oxidation furnace as claimed in claim 1, wherein the primary blowing-in device comprises one or more primary blowing-in boxes and the secondary blowing-in device comprises one or more secondary blowing-in boxes.

8. The oxidation furnace as claimed in claim 7, wherein a primary blowing-in box and a secondary blowing-in box, which are arranged in the same subspace, are arranged directly next to one another and blow primary gas or secondary gas in opposite directions.

9. The oxidation furnace as claimed in claim 8, wherein a fresh gas feed device by means of which fresh gas can be blown into the interior space is present at the blowing-in end of the housing, with the fresh gas feed device being arranged in particular on the side of the secondary suction device facing away from the process space.

10. The oxidation furnace as claimed in claim 1, wherein a secondary suction device by means of which a substream of the secondary gas which flows away from the process space can be sucked away.

11. An oxidation furnace for the oxidative treatment of fibers, comprising:

a) a housing having an interior space which is gastight apart from regions for the passage of fibers;

b) a process space located in the interior space of the housing;

c) deflection rollers which guide the fibers as fiber carpet next to one another in a serpentine manner through the process space, where the fiber carpet in each case spans a plane between opposite deflection rollers and a subspace of the interior space is in each case defined above and below these planes;

d) a primary blowing-in device arranged at a blowing-in end of the housing and a primary suction device between which the process space extends, where a primary gas can be blown by means of the primary blowing-in device into a subspace in such a way that the process gas flows in a process flow direction through the process space;

wherein e) a flow sealing device by means of which a secondary gas can be blown by means of a secondary blowing-in device on the side of the primary blowing-in device opposite the process space into the subspace is provided, and further wherein the primary gas can be blown into each subspace by means of the primary gas blowing-in device and the secondary gas can be blown into each subspace by means of the secondary blowing-in device, and each subspace includes a secondary gas diversion device by means of which the secondary gas stream in the respective subspace is diverted in such a way that secondary gas partly flows in the direction toward the process space and partly flows in the direction away from the process space.

12. The oxidation furnace as claimed in claim 11, wherein a pressure drop coefficient of the flow path of the secondary gas in the subspace can be set.

13. The oxidation furnace as claimed in claim 11, wherein each secondary gas diversion device comprises a transfer guide device on the secondary blowing-in device and a diversion element, with a flow channel being formed between the transfer guide device and the diversion element.

14. The oxidation furnace as claimed in claim 13, wherein each diversion element is movable and the flow channel can be altered.

15. The oxidation furnace as claimed in claim 11, wherein the primary blowing-in device comprises one or more primary blowing-in boxes and the secondary blowing-in device comprises one or more secondary blowing-in boxes.

16. The oxidation furnace as claimed in claim 15, wherein a primary blowing-in box and a secondary blowing-in box, which are arranged in the same subspace, are arranged directly next to one another and blow primary gas or secondary gas in in opposite directions.

17. The oxidation furnace as claimed in claim 16, wherein a fresh gas feed device by means of which fresh gas can be blown into the interior space is present at the blowing-in end of the housing, with the fresh gas feed device being arranged in particular on the side of the secondary suction device facing away from the process space.

18. The oxidation furnace as claimed in claim 11, wherein a secondary suction device by means of which a substream of the secondary gas which flows away from the process space can be sucked away.

19. An oxidation furnace for the oxidative treatment of fibers, comprising:

a) a housing having an interior space which is gastight apart from regions for the passage of fibers;

b) a process space located in the interior space of the housing;

c) deflection rollers which guide the fibers as fiber carpet next to one another in a serpentine manner through the process space, where the fiber carpet in each case spans a plane between opposite deflection rollers and a subspace of the interior space is in each case defined above and below these planes;

d) a primary blowing-in device arranged at a blowing-in end of the housing and a primary suction device between which the process space extends, where a primary gas can be blown by means of the primary blowing-in device into a subspace in such a way that the process gas flows in a process flow direction through the process space;

e) a flow sealing device by means of which a secondary gas can be blown by means of a secondary blowing-in device on the side of the primary blowing-in device opposite the process space into the subspace is provided, and f) a secondary suction device by means of which a substream of the secondary gas which flows away from the process space can be sucked away.

20. The oxidation furnace as claimed in claim 19, wherein the secondary gas blown in flows partly in the direction toward the process space and partly in the direction away from the process space.

21. The oxidation furnace as claimed in claim 20, wherein a pressure drop coefficient of the flow path of the secondary gas in the subspace can be set.

22. The oxidation furnace as claimed in claim 19, wherein the flow sealing device comprises a secondary gas diversion device by means of which the secondary gas stream is diverted in such a way that secondary gas partly flows in the direction toward the process space and partly flows in the direction away from the process space, and the secondary gas diversion device comprises a transfer guide device on the secondary blowing-in device and a diversion element, with a flow channel being formed between the transfer guide device and the diversion element.

23. The oxidation furnace as claimed in claim 22, wherein the diversion element is movable and the flow channel can be altered.

24. The oxidation furnace as claimed in claim 19, wherein the primary gas can be blown into each subspace by means of the primary gas blowing-in device and the secondary gas can be blown into each subspace by means of the secondary blowing-in device.

25. The oxidation furnace as claimed in claim 19, wherein the primary blowing-in device comprises one or more primary blowing-in boxes and the secondary blowing-in device comprises one or more secondary blowing-in boxes.

26. The oxidation furnace as claimed in claim 25, wherein a primary blowing-in box and a secondary blowing-in box, which are arranged in the same subspace, are arranged directly next to one another and blow primary gas or secondary gas in opposite directions.

27. The oxidation furnace as claimed in claim 26, wherein a fresh gas feed device by means of which fresh gas can be blown into the interior space is present at the blowing-in end of the housing, with the fresh gas feed device being arranged in particular on the side of the secondary suction device facing away from the process space.

28. An oxidation furnace for the oxidative treatment of fibers, comprising:

a) a housing having an interior space which is gastight apart from regions for the passage of fibers;

b) a process space located in the interior space of the housing;

c) deflection rollers which guide the fibers as fiber carpet next to one another in a serpentine manner through the process space, where the fiber carpet in each case spans a plane between opposite deflection rollers and a subspace of the interior space is in each case defined above and below these planes;

d) a primary blowing-in device arranged at a blowing-in end of the housing and a primary suction device between which the process space extends, where a primary gas can be blown by means of the primary blowing-in device into a subspace in such a way that the process gas flows in a process flow direction through the process space;

e) a flow sealing device by means of which a secondary gas can be blown by means of a secondary blowing-in device on the side of the primary blowing-in device opposite the process space into the subspace is provided;

f) a primary blowing-in box and a secondary blowing-in box, which are arranged in the same subspace, are arranged directly next to one another and blow primary gas or secondary gas in in opposite directions; and g) a fresh gas feed device by means of which fresh gas can be blown into the interior space is present at the blowing-in end of the housing, with the fresh gas feed device being arranged in particular on the side of the secondary suction device facing away from the process space.

29. The oxidation furnace as claimed in claim 28, wherein the secondary gas blown in flows partly in the direction toward the process space and partly in the direction away from the process space.

30. The oxidation furnace as claimed in claim 29, wherein a pressure drop coefficient of the flow path of the secondary gas in the subspace can be set.

31. The oxidation furnace as claimed in claim 28, wherein the flow sealing device comprises a secondary gas diversion device by means of which the secondary gas stream is diverted in such a way that secondary gas partly flows in the direction toward the process space and partly flows in the direction away from the process space, and the secondary gas diversion device comprises a transfer guide device on the secondary blowing-in device and a diversion element, with a flow channel being formed between the transfer guide device and the diversion element.

32. The oxidation furnace as claimed in claim 31, wherein the diversion element is movable and the flow channel can be altered.

33. The oxidation furnace as claimed in claim 28, wherein the primary gas can be blown into each subspace by means of the primary gas blowing-in device and the secondary gas can be blown into each subspace by means of the secondary blowing-in device.

34. The oxidation furnace as claimed in claim 28, wherein the primary blowing-in device comprises one or more primary blowing-in boxes and the secondary blowing-in device comprises one or more secondary blowing-in boxes.

* * * * *